US006775485B1

(12) United States Patent
Maurer et al.

(10) Patent No.: US 6,775,485 B1
(45) Date of Patent: Aug. 10, 2004

(54) IMAGE FORMING DEVICE COMPONENT RETENTION SYSTEM

(75) Inventors: Craig A. Maurer, San Diego, CA (US); James Clough, Boise, ID (US); Darrel Cherry, Boise, ID (US); Steven H. Chiu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/457,162

(22) Filed: Jun. 9, 2003

(51) Int. Cl.[7] ..... G03G 15/00
(52) U.S. Cl. ..... 399/9; 399/111

(58) Field of Search ..... 399/9, 12, 13, 399/75, 76, 77, 80, 81, 107, 111, 119, 120, 224, 262

(56) References Cited

U.S. PATENT DOCUMENTS 5,809,370 A * 9/1998 Ueno ..... 399/81

* cited by examiner

*Primary Examiner*—Hoang Ngo

(57) ABSTRACT

In one embodiment, an image forming device is provided that includes a replaceable component. The image forming device includes an operating state configured to form images utilizing the component. The image forming device further includes a security state configured to reduce access to the replaceable component in response to a triggering event.

30 Claims, 3 Drawing Sheets

IMAGE FORMING DEVICE COMPONENT RETENTION SYSTEM

BACKGROUND

Image forming devices, such as ink jet printers, are available in many public locations. Replaceable components (e.g., ink cartridges) used by these devices can be an attractive target for theft. Loss of such components to, for example, theft can quickly undermine any profitability associated with providing such public access to image forming devices.

BRIEF DESCRIPTION OF THE DRAWINGS

It will be appreciated that the illustrated boundaries of elements (e.g. boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa.

DETAILED DESCRIPTION OF ILLUSTRATED EMBODIMENTS

Figure 1:
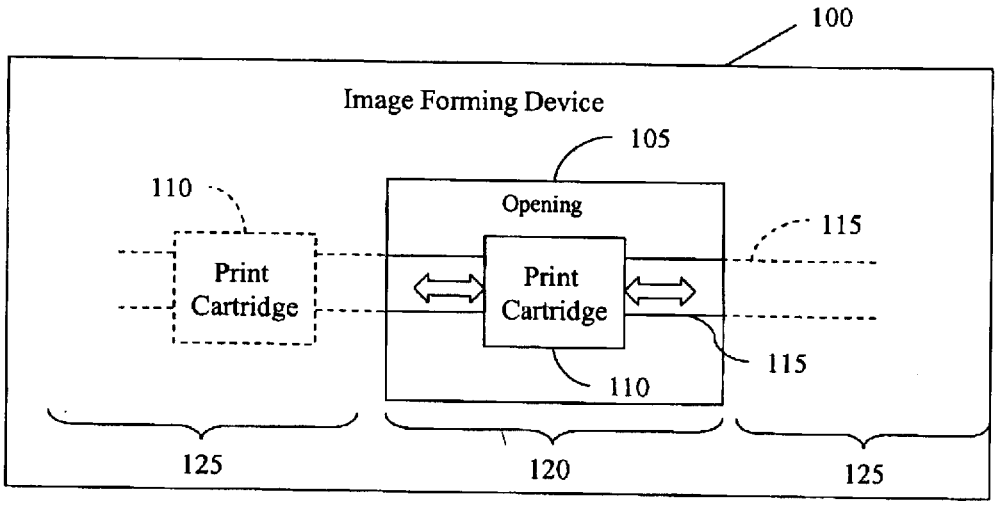
FIG. 1 is one embodiment of an image forming device configured to reduce accessibility to a replaceable printing component.

The following includes definitions of selected terms used throughout the disclosure. The definitions include examples of various embodiments and/or forms of components that fall within the scope of a term and that may be used for implementation. Of course, the examples are not intended to be limiting and other embodiments may be implemented. Both singular and plural forms of all terms fall within each meaning:

"Computer-readable medium", as used herein, refers to any medium that participates in directly or indirectly providing signals, instructions and/or data to one or more processors for execution. Such a medium may take many forms, including but not limited to, non-volatile media, volatile media, and transmission media. Non-volatile media may include, for example, optical or magnetic disks. Volatile media may include dynamic memory. Transmission media may include coaxial cables, copper wire, and fiber optic cables. Transmission media can also take the form of electromagnetic radiation, such as those generated during radio-wave and infra-red data communications, or take the form of one or more groups of signals. Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, a PROM, an EPROM, a FLASH-EPROM, any other memory chip or card, a carrier wave/pulse, or any other medium from which a computer, a processor or other electronic device can read. Signals used to propagate instructions or other software over a network, such as the Internet, are also considered a "computer-readable medium."

"Logic", as used herein, includes but is not limited to hardware, firmware, software and/or combinations of each to perform a function(s) or an action(s), and/or to cause a function or action from another component. For example, based on a desired application or needs, logic may include a software controlled microprocessor, discrete logic such as an application specific integrated circuit (ASIC), a programmable/programmed logic device, memory device containing instructions, or the like. Logic may also be fully embodied as software.

"Signal", as used herein, includes but is not limited to one or more electrical signals, analog or digital signals, one or more computer or processor instructions, messages, a bit or bit stream, or other means that can be received, transmitted, and/or detected.

"Software", as used herein, includes but is not limited to one or more computer readable and/or executable instructions that cause a computer or other electronic device to perform functions, actions, and/or behave in a desired manner. The instructions may be embodied in various forms such as objects, routines, algorithms, modules or programs including separate applications or code from dynamically linked libraries. Software may also be implemented in various forms such as a stand-alone program, a function call, a servlet, an applet, instructions stored in a memory, part of an operating system or other type of executable instructions. It will be appreciated by one of ordinary skill in the art that the form of software may be dependent on, for example, requirements of a desired application, the environment it runs on, and/or the desires of a designer/programmer or the like.

"User", as used herein, includes but is not limited to one or more persons, software, computers or other devices, or combinations of these.

Illustrated in FIG. 1 is one embodiment of an image forming device 100 that is configured to protect access to internal components such as replaceable or otherwise removable components that are within the image forming device 100. In one embodiment, access to internal components of the image forming device 100 may be provided by an opening 105 formed within a housing or other type of enclosure of the image forming device 100. The opening 105 may include an openable and closeable access door. As illustrated in FIG. 1, the access door is not shown and the opening 105 is shown in an open state.

The image forming device 100 can be a printer, copier, an all-in-one product, a multifunctional peripheral, or other device that can form an image onto print media. The image forming device 100 can include various types of imaging mechanisms based on, for example, technologies such as ink jet, piezoelectric, thermal printing, laser printing, digital imaging, impact printing, or other available technologies. The following embodiment will be described based on an ink jet printer that includes a replaceable ink cartridge.

Within the image forming device, one type of replaceable component may include a print cartridge 110 such as an ink cartridge used in ink-jet printing devices. It will be appreciated that the term "print cartridge" is used generically to represent any type of removable cartridge that may store and/or supply a marking material to an imaging mechanism. A print cartridge may also perform actual printing if, for example, a print head is included. The marking material may include ink, toner, or other type of material and, the material may be in a variety of forms such as liquid, semi-liquid, powder, solid, semi-solid, or other forms. Although the term "ink" is used in the following examples, it will be appreciated that other marking materials can be easily substituted.

Various configurations of the print cartridge 110 may also be provided. For example, the print cartridge 110 may include one or more ink reservoirs, or one or more ink reservoirs combined with an ink jet printhead or other type of printing mechanism.

In one embodiment, the print cartridge 110 is moved along a track or carriage 115. The image forming device 100 is configured to move the print cartridge 110 back and forth along the carriage 115 during a printing operation in order to form an image on a print media. A controller (not shown) can be configured to provide instructions for causing the movement of the carriage 115. The path taken by the carriage 115 during a printing operation may also be referred to herein as an "imaging path". The print cartridge 110 may be connected to the carriage 115 in a variety of ways such as being attachable and detachable by snapping in and out, respectively.

With regard to the prevention of access to the print cartridge 110, the image forming device 100 and the controller are configured to position the print cartridge 110, such as by moving, retracting, or maintaining, to a position that is less accessible by a user when the access door is opened. Opening the access door would expose the opening 105. For example, when the print cartridge 110 is positioned within a perimeter of the opening 105, the print cartridge 110 is accessible and easily removable by a user. This position or area is represented by access position 120. However, when the image forming device 100 detects that the access door is opened, the print cartridge 110 would be positioned in a retention position 125 from which access is more difficult.

Positioning the print cartridge 110 may include moving the print cartridge 110 to the retention position 125, or may include maintaining the print cartridge 110 at its current position if the print cartridge is already positioned outside the access position 120. Thus, the print cartridge 110 would be substantially more difficult to remove through the opening 105. In one embodiment, the retention position 125 may be any selected location outside the perimeter of the opening 105. As such, the retention position 125 is shown and represented by retention areas indicated by reference numbers 125. As will be described in more detail below, the system can further be configured to move the print cartridge to the access position 120 if a valid authorization code is entered.

In this manner, an unauthorized user can be substantially prevented from removing or otherwise stealing the print cartridge 110 from the image forming device 100. Thus, the ability to remove the print cartridge through the access door is reduced. It will be appreciated that opening of the access door is one type of security triggering event that can initiate the moving of the print cartridge 110 to the retention position 125. Other types of security triggering events may include opening other doors or compartments of the housing, unscrewing or otherwise removing the housing to expose the internal components of the image forming device, detecting a loss of power, or other type of desired triggering event. The image forming device 100 can be configured to detect one or more of these security triggering events as desired.

Figure 2:
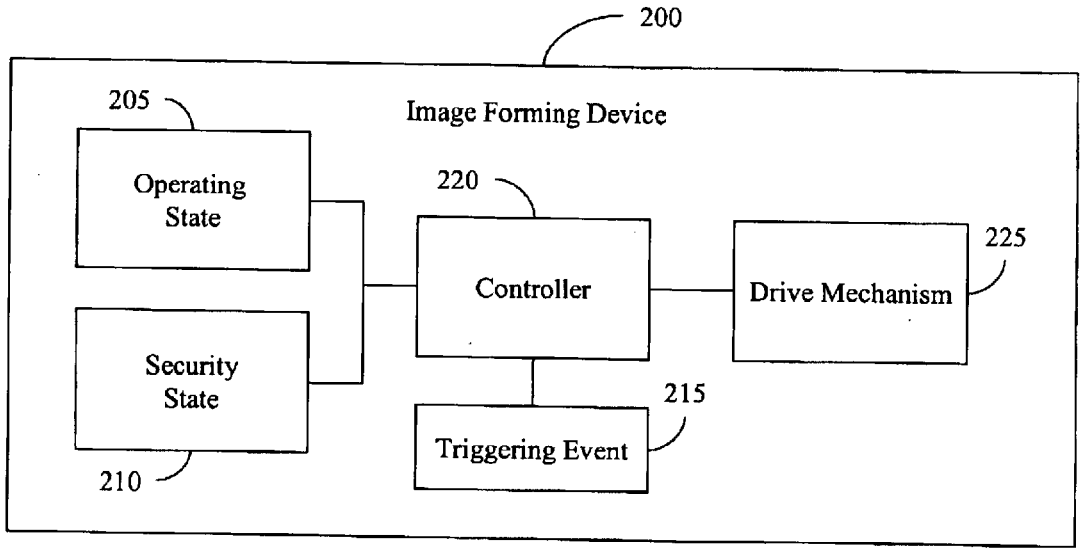
FIG. 2 is another embodiment of an image forming device configured with at least two states.

Illustrated in FIG. 2 is another embodiment of an image forming device 200 configured to change its state between an operating state 205 and a security state 210. Of course, other states of the image forming device 200 may also be provided. The operating state 205 includes, for example, a state where the image forming device is configured to form images in accordance with imaging instructions. Other examples may be a waiting or suspended state where the image forming device 200 is operational but is between print jobs, a paused state such as due to an error or malfunction, or other state that is not associated with the security state 210.

In that regard, the security state 210 includes a state where the image forming device 200 is configured to reduce access to a print cartridge in response to a triggering event 215. The triggering event 215 may include, but is not limited to, detecting or sensing when a door of the image forming device 200 is opened, when another part of the housing is opened which may provide access to internal components of the image forming device 200, when power to the image forming device 200 is lost or otherwise removed, or combinations of these events. In general, a triggering event may be defined based on its potential to increase the risk of unauthorized access and/or theft of the print cartridge (e.g. an ink jet or toner cartridge).

In one embodiment, a controller 220 includes logic configured to changed the state of the image forming device 200 between the operating state 205 and the security state 210. For example, in response to a detected triggering event 215, the controller 220 can cause instructions or other signals to be sent to a drive mechanism 225 that cause the drive mechanism 225 to move the print cartridge so as to reduce accessibility to the print cartridge. For example, the controller 220 can cause the drive mechanism 225 to move the print cartridge to a security position away from an open door, such as outside of the door's perimeter. In this manner, an unauthorized user may be deterred from removing the print cartridge from the image forming device 200.

If an authorized user wishes to remove the print cartridge, for example, to replace an empty print cartridge, the controller 220 can be configured to cause the drive mechanism 225 to move the print cartridge to an access position. At the access position, the print cartridge can then be removed. In one embodiment, the image forming device 200 can be configured to allow access to the print cartridge in response to a valid authorization code being received from the user. The authorization code may be a password, a code, a key sequence, or other predefined signal. The image forming device 200 can also be configured to automatically allow access when no print cartridges are present, if both of them are detected to be empty, or other internally triggered signals.

In another embodiment, the image forming device 200 can be configured to detect a loss or removal of power to the device which can be defined as a triggering event. This configuration may reduce the likelihood that an unauthorized user could unplug the image forming device 200 and then open the device to remove the print cartridge, thereby, by-passing other security features. For example, the image forming device 200 may include a backup or alternative power supply (not shown) such as a battery, capacitor, or other power source. When main power to the image forming device 200 is lost, power from the backup power supply can be used to move the print cartridge to the retention position. Alternately, the backup power supply can be used in association with a door opening or other triggering event if power is lost. Thus, loss of power would not automatically initiate protection of the print cartridge. Of course, triggering events can be defined as desired. In this manner, additional security can be provided to protect the print cartridge.

Figure 3:
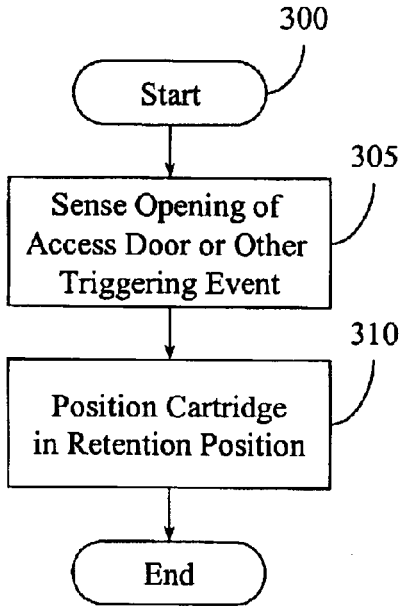
FIG. 3 is one embodiment of a methodology for retaining a cartridge.

Illustrated in FIG. 3 is one embodiment of a methodology to prevent unauthorized access to or even theft of a print cartridge or other removable print component. The illustrated elements denote "processing blocks" and represent software instructions or groups of instructions that cause an image forming device, a controller, and/or other components, to perform an action(s) and/or to make decisions. Alternatively, the processing blocks may represent functions and/or actions performed by functionally equivalent circuits such as a digital signal processor circuit, an application specific integrated circuit (ASIC), or other logic device. The diagram, as well as the other illustrated diagrams, do not depict syntax of any particular programming language. Rather, the diagram illustrates functional information one skilled in the art could use to fabricate circuits, generate computer software, or use a combination of hardware and software to perform the illustrated processing. It will be appreciated that electronic and software applications may involve dynamic and flexible processes such that the illustrated blocks can be performed in other sequences different than the one shown and/or blocks may be combined or, separated into multiple components. They may also be implemented using various programming approaches such as machine language, procedural, object oriented and/or artificial intelligence techniques. The foregoing applies to all methodologies described herein.

With reference to FIG. 3, the process is initiated upon sensing the opening of an access door or other triggering event (block 305). As discussed previously, the triggering event may be any selected event that may allow access to the print cartridge within an image forming device. In response to the detection of the triggering event, the cartridge is moved or retracted to a retention position (block 310). For example, the retention position may include a position where a cartridge is away from an access door or other opening in the image forming device. The retention position may also be a position where the cartridge sits when the device is not printing such as a stand-by position. Thus in another embodiment, if the cartridge is in its stand-by position away from the access door and the triggering event is detected, the cartridge would simply be maintained in that position without moving the cartridge.

Figure 4:
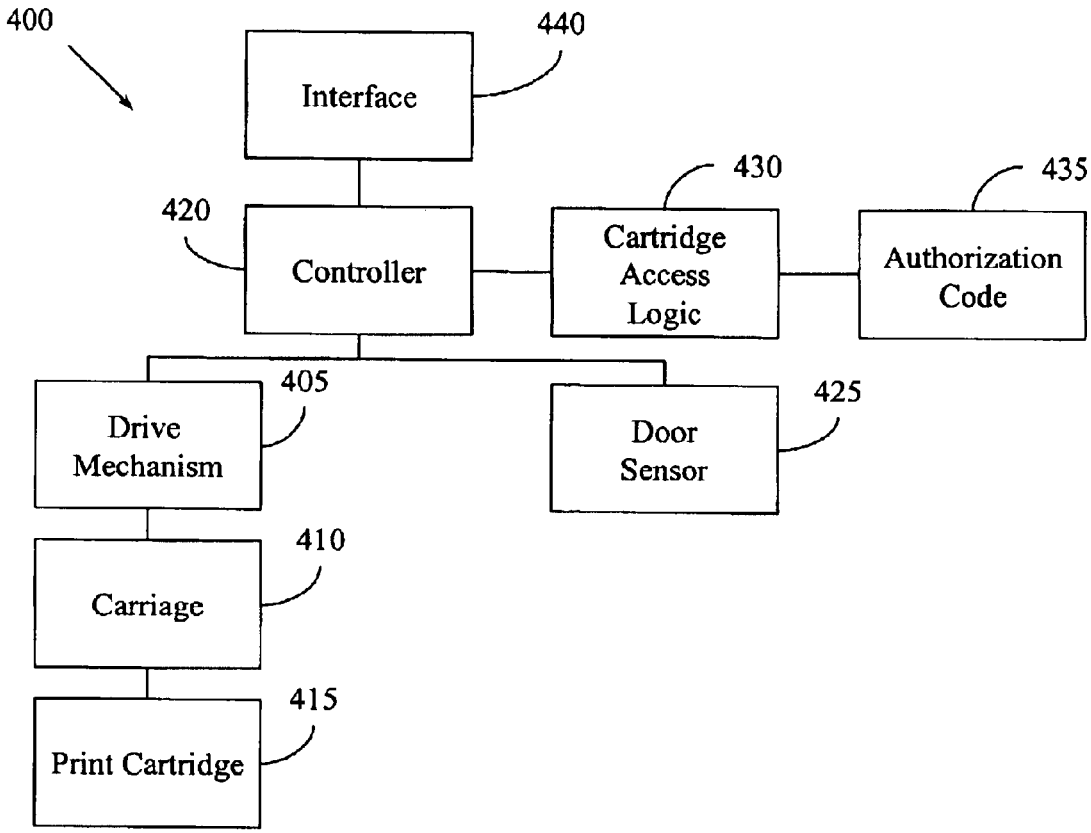
FIG. 4 is another embodiment of an image forming device.

With reference to FIG. 4, another embodiment of an image forming device 400 is shown that is configured to prevent unauthorized access to a print cartridge and also to allow access to the print cartridge if the access is authorized. For example, a drive mechanism 405 is configured to operate with a track or carriage 410 that supports a removable printing component such as print cartridge 415. The drive mechanism 405 may include one or more gears, drive shafts, pulleys, or other means to move the print cartridge 415 along or with the carriage 410 in response to instructions from a controller 420.

In one embodiment, a door sensor 425 is provided that operates with an access door or panel provided on a housing of the image forming device. The door sensor 425 is configured to sense whether the door is opened and closed, and transmits a signal to the controller 420 that indicates the state of the door. Various configurations of the door sensor 425 can be used such as an optical sensor that is triggered by the presence or absence of the door. Other examples may include an electrical sensor where the door opens or closes an electrical switch depending on the door's position. The door sensor 425 may be a flag sensor that can be depressed by the door when the door is closed and that pops up when the door is opened. Other types of electrical and mechanical sensors can be used, as well as combinations of these types of sensors.

In response to the door being opened, the door sensor 425 transmits a door open signal to the controller 420 indicating the door is opened. This causes the controller 420 to instruct the drive mechanism 405 to move the print cartridge 415 to a retention position. The retention position, as explained previously, is a position that prevents removal of the print cartridge 415 when the door is opened, or at least is a position that reduces the ability to access the print cartridge 415. Making it more difficult to access the cartridge 415 may deter theft. While in the retention position, the image forming device can be regarded as being in the security state as previously described.

The controller 420 is further configured to cause the drive mechanism 405 to operate normally once the door is closed. Thus, when the access door is closed, the door sensor 425 transmits a door closed signal to the controller 420 which indicates that access to the image forming device is no longer being attempted. The image forming device 400 is then returned to a normal operating state.

With further reference to FIG. 4, the controller 420 may also be configured to allow access to the print cartridge 415 if the access is authorized. In one embodiment, a cartridge access logic 430 is configured to determine whether access is authorized. For example, one or more authorization codes 435 can be predefined and stored in the image forming device 400. The authorization code 435 may include a password, a key sequence, or other type of desired code that when received by the controller 420, the print cartridge 415 is moved to an access position allowing it to be removed, inspected, repaired or the like.

In one embodiment, an authorization code can be inputted to the image forming device 400 through an interface 440 such as a control panel. The interface 440 may also be software such as a device driver or other program executable on a computer in communication with the image forming device 400. In this manner, a user can input an authorization code via the computer and transmit it to the image forming device 400. Upon receiving an inputted authorization code, the cartridge access logic 430 is configured to compare the inputted code to the one or more predefined authorization codes 435 and determine whether the inputted code is valid. If the inputted code is valid, by matching one of the authorization codes 435, the controller 420 causes the print cartridge 415 to be moved to the access position. If the inputted code is not valid, the print cartridge 415 remains in the retention position.

Figure 5:
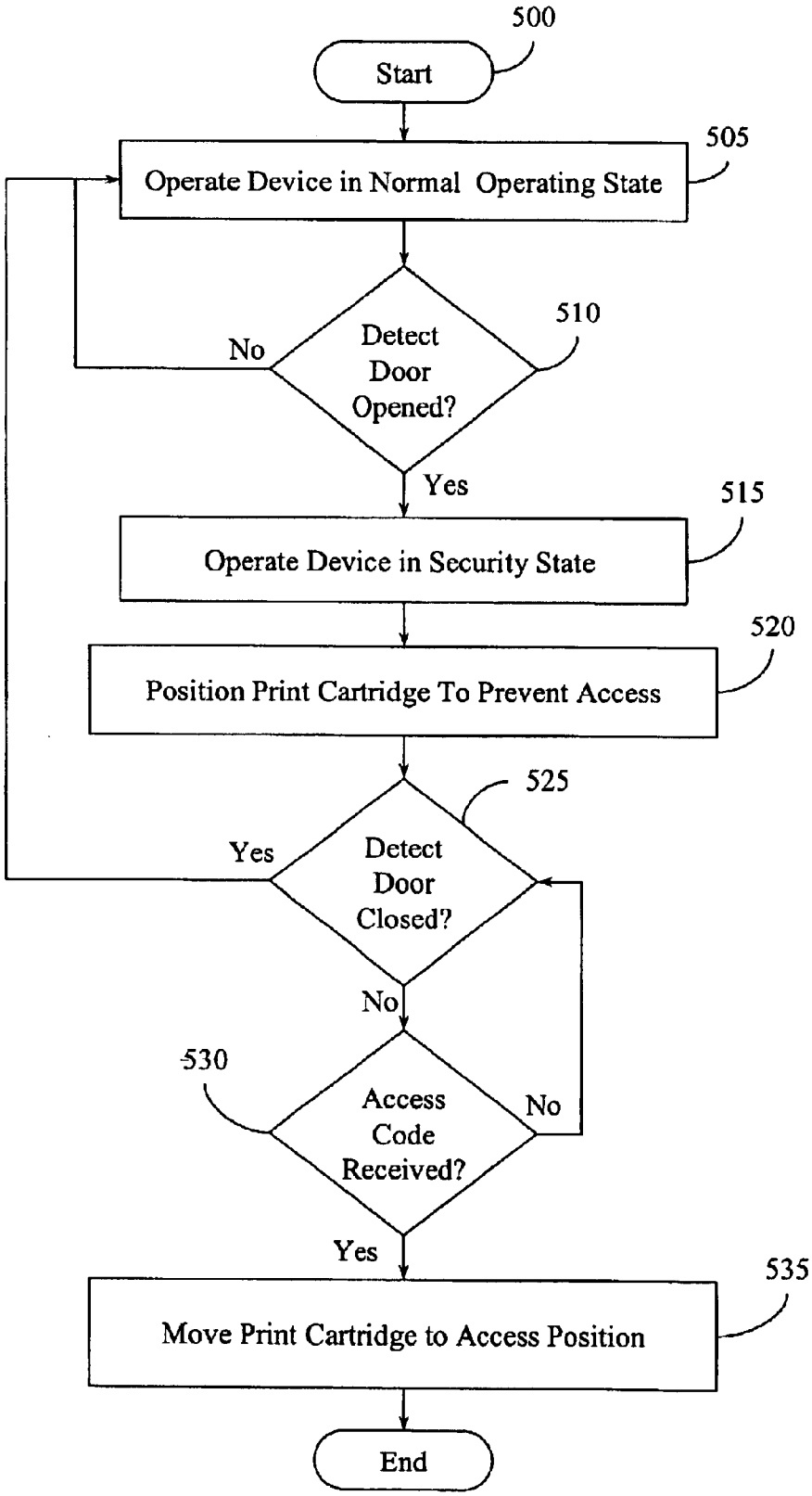
FIG. 5 is one embodiment of a methodology for protecting a print cartridge.

Illustrated in FIG. 5 is another embodiment of a methodology 500 that can change the state of an image forming device between a normal operating state and a security state which reduces access to a print cartridge. Once the image forming device is, for example, powered on, it is operated in a normal operating state 505. In this state, the imaging device can be ready to receive print requests, can be currently processing a print request, can be paused or suspended due to an error or a malfunction, can be paused by a user, and the like.

The operating state is continued until a door of the image forming device is detected to be opened (block 510). As discussed previously, the determination at block 510 can be based on one or more security triggering events which may or may not require a door to be opened. This example uses the triggering event as the door being opened for illustrative purposes only. Once it is detected that the door is opened, the image forming device is then operated in a security state (block 515). Here, the print cartridge is positioned or maintained in a retention position so as to prevent access to the print cartridge or at least to reduce accessibility to the print cartridge (block 520).

The image forming device is maintained in the security state until at least one of two events occur. For example, if it is detected that the door is closed (block 525), the threat of an unauthorized access to the print cartridge is removed and the image forming device is returned to its normal operating state (block 505). However, if the door remains open and a valid access code is received (block 530), the print cartridge is moved to an access position (block 535). If a valid access code is not received and the door remains open, the process remains in the security state.

Although not shown in the illustrated methodology in FIG. 5, once at the access position (block 535), the print cartridge can be accessed for maintenance, replacement of components, inspection, or other desired reason. Once the access door is again closed, the process returns to a normal operating state and the imaging device functions as normal.

It will be appreciated that in one or more of the described embodiments, the system can be configured to maintain a print cartridge in a retention position in response to a detected triggering event. For example, if the print cartridge is positioned in a retention position when a triggering event occurs, the system can be configured to keep the cartridge in place without moving the cartridge. In another embodiment, the print cartridge can be moved from one retention position to a different retention position if desired.

It will also be appreciated that more than one retention position can exist and the system can be configured to select a retention position from any available positions. In one embodiment, the retention position can be pre-selected and set prior to being put into operation. In another embodiment, the retention position can be selected on-the-fly during operation.

Suitable software for implementing the various components of the present system and method using the teachings presented here include programming languages and tools such as Java, Pascal, C#, C++, C, CGI, Perl, SQL, APIs, SDKs, assembly, firmware, microcode, and/or other languages and tools. The components embodied as software include computer readable/executable instructions that cause one or more computers, processors and/or other electronic device to behave in a prescribed manner. Any software, whether an entire system or a component of a system, may be embodied as an article of manufacture and maintained as part of a computer-readable medium as defined previously. Another form of the software may include signals that transmit program code of the software to a recipient over a network or other communication medium. It will be appreciated that components described herein may be implemented as separate components or may be combined together.

While the present invention has been illustrated by the description of embodiments thereof, and while the embodiments have been described in considerable detail, it is not the intention of the applicants to restrict or in any way limit the scope of the appended claims to such detail. Additional advantages and modification will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. An image forming device comprising:

a housing including an access door; and a controller configured to position a removable print cartridge in a retention position in response to the access door being opened, the retention position being a position where an ability to remove the removable print cartridge from the access door is reduced.

2. The image forming device of claim 1 where, if the removable print cartridge is in the retention position and the access door is opened, the controller is configured to maintain the removable print cartridge in the retention position.

3. The image forming device of claim 1 further including a door sensor configured to determine whether the access door is opened.

4. The image forming device of claim 1 wherein the controller includes executable instructions that cause a carriage to position the removable print cartridge in the retention position.

5. The image forming device of claim 1 wherein the controller is further configured to move the removable print cartridge from the retention position to an access position that allows removal of the removable print cartridge in response to an authorization code.

6. The image forming device of claim 5 wherein the authorization code includes a key sequence.

7. The image forming device of claim 1 wherein the retention position is located at a selected position from one or more positions outside a perimeter of the access door.

8. An article of manufacture embodied in a computer-readable medium for use in an image forming device having an access panel and a print cartridge, the article of manufacture comprising:

first processor executable instructions for causing the print cartridge to be positioned in a location that prevents removal of the print cartridge when the access panel is opened; and second processor executable instructions for causing, in response to a valid authorization code being received, the print cartridge to be moved to a position that permits removal of the print cartridge.

9. The article of manufacture as set forth in claim 8 further including third processor executable instructions for determining when the access door is opened.

10. The article of manufacture as set forth in claim 8 further including fourth processor executable instructions for comparing a received authorization code to one or more valid authorization codes.

11. The article of manufacture as set forth in claim 8 wherein the first processor executable instructions include instructions for causing a drive mechanism to move the print cartridge.

12. A method of operating an image forming device having a removable print cartridge, the method comprising the acts of:

detecting an occurrence of a security triggering event; and retracting the print cartridge to a retention position that reduces an ability to remove the print cartridge when the security triggering event is detected if the print cartridge is at a position different than the retention position.

13. The method as set forth in claim 12 further including moving the print cartridge to an access position that allows removal of the print cartridge in response to an authorization signal.

14. The method as set forth in claim 13 further including comparing the authorization signal to one or more valid authorization signals.

15. The method as set forth in claim 12 wherein the retracting act includes a step for reducing accessibility to the print cartridge in response to the security triggering event is detected.

16. The method as set forth in claim 12 wherein the detecting act includes sensing when a door of the image forming device is opened.

17. The method as set forth in claim 12 wherein the security triggering event is a detected loss of power.

18. An image forming device comprising:

a replaceable component;

an operating state configured to form images utilizing the component; and a security state configured to reduce access to the replaceable component in response to a triggering event.

19. The image forming device as set forth in claim 18 wherein the replaceable component includes a print cartridge.

20. The image forming device as set forth in claim 18 further including a carriage configured to move the replaceable component.

21. The image forming device as set forth in claim 18 further including means for detecting the triggering event.

22. The image forming device as set forth in claim 18 further including a controller configure to change the image forming device between the operating state and the security state.

23. The image forming device as set forth in claim 22 wherein the controller is configured to change the image forming device from the security state to the operating state in response to a valid authorization code.

24. The image forming device as set forth in claim 22 wherein the controller is embodied as logic.

25. The image forming device as set forth in claim 18 wherein the triggering event is associated with opening of a door of the image forming device.

26. The image forming device as set forth in claim 18 wherein the triggering event is associated with a loss of power to the image forming device.

27. The image forming device as set forth in claim 18 further including a controller configured to change the image forming device from the security state to the operating state if a valid authorization code is received.

28. The image forming device as set forth in claim 18 wherein the replaceable component is a print cartridge that supplies toner.

29. The image forming device as set forth in claim 18 wherein the replaceable component includes an ink cartridge that supplies ink.

30. The image forming device as set forth in claim 27 wherein the controller is configured to receive the authorization code from a remote computer.

* * * * *